United States Patent [19]

de Does

[11] 3,943,872

[45] Mar. 16, 1976

[54] SHIP FOR THE TRANSPORT OF LIQUID OR GASEOUS CARGO IN TANKS

[75] Inventor: Joan Charles de Does, Maasland, Netherlands

[73] Assignee: Verolme Verenigde Scheepswerven B.V., Rotterdam, Netherlands

[22] Filed: Mar. 22, 1974

[21] Appl. No.: 453,785

[30] Foreign Application Priority Data

Mar. 23, 1973 Netherlands ..... 7304083

[52] U.S. Cl. ..... 114/74 R

[51] Int. Cl.² ..... B63B 25/08

[58] Field of Search ..... 114/.5 F, .5 T, 56, 59, 114/61, 65 R, 66.5 R, 66.5 F, 74 R, 74 T, 74 A, 75, 77 R, 77 A, 78, 43.5; 62/240

[56] References Cited

UNITED STATES PATENTS

| | | | |
|---|---|---|---|
| 795,002 | 7/1905 | Nelson | 114/61 |
| 3,072,087 | 1/1963 | Henry | 114/74 A |

*Primary Examiner*—Trygve M. Blix
*Assistant Examiner*—Jesus D. Sotelo

[57] ABSTRACT

A ship for the transport of liquid or gaseous cargo (especially liquid gas) in tanks comprises a plurality of supporting hulls, a plurality of cargo tanks, and a connection structure superimposed on said hulls and maintaining the tanks spaced above the hulls and accessible from all sides. The abeam dimension of the tanks is preferably smaller than the abeam dimension of the connected hulls.

5 Claims, 11 Drawing Figures

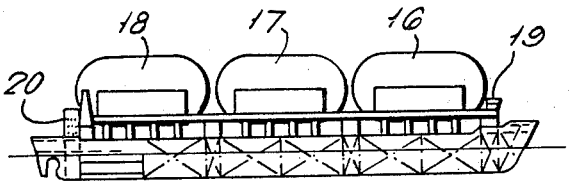
FIG. 1.
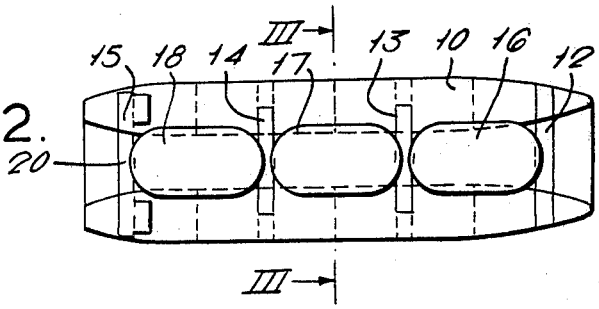
FIG. 2.
FIG. 3.
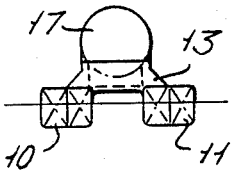
FIG. 4.
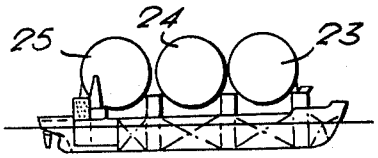
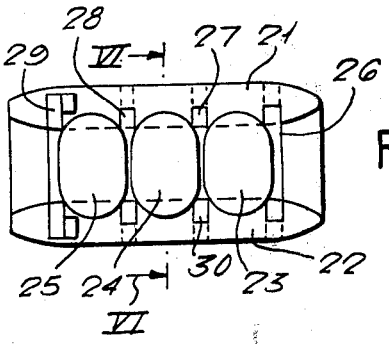
FIG. 5.
FIG. 6.
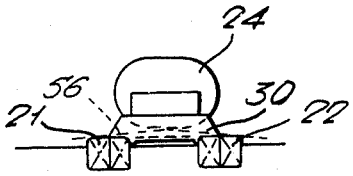

FIG. 7.
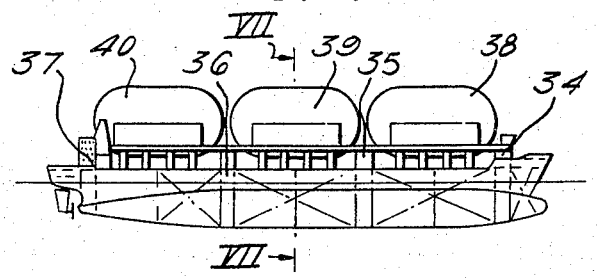
FIG.8.
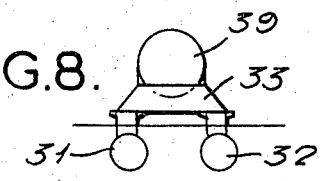
FIG.9.
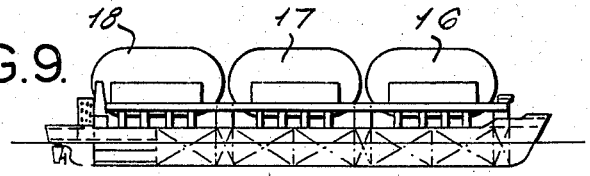
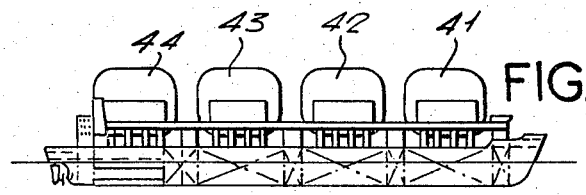
FIG. 10
FIG.11.
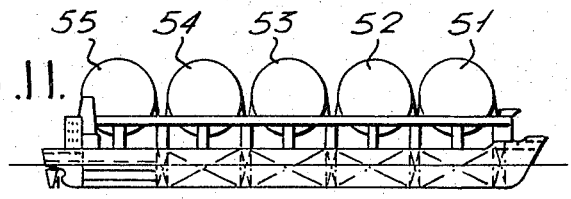

SHIP FOR THE TRANSPORT OF LIQUID OR GASEOUS CARGO IN TANKS

BACKGROUND OF THE INVENTION

The present invention relates to a ship for the transport of liquid or gaseous cargo in tanks.

An example of such a ship is a tanker for the transport of liquid gases having a boiling point below ambient temperature at atmospheric pressure, typically a boiling point below −100°C. Such a ship must be built as a double hull ship according to pending requirements; i.e., a ship with a double bottom and side tanks. Within the innermost ship's skin are the insulated cargo tanks and a second barrier—between cargo tanks and the innermost skin—to keep the liquid gas away from the innermost skin in case of leakage of a cargo tank, so that leaking gas cannot undercool the ship's hull and thus cause cold brittleness which might lead to fracture of the ship's hull. Furthermore, as additional security for said ships, transversely extending cofferdam partitions are prescribed as subdivisions between the insulated cargo tanks.

Such double hull ships are not entirely satisfactory for a number of reasons.

The enclosure of the cargo tanks, insulations, second barrier, side tanks and double bottom, etc. all require considerable ship space. And because the side tanks tend to be relatively narrow to conserve ship space, the cargo tanks, positioned immediately interiorly of the side tanks, are very vulnerable in case of collision.

Because it is at least difficult, and often impossible, to directly inspect the integrity of the tanks, the insulation and the second barrier, all spaces between the cargo tanks and the innermost ship's hull have to be neutralized with the aid of inert gas. In order to determine the existence of leakage from the cargo tanks, the inert gas must be continuously examined regarding the presence of traces of the cargo in the cargo hold.

The construction of the cargo tanks, the insulation and the second barrier (or leak pans) inside the ship's hull is both complicated and expensive to manufacture and maintain. For example, a special steel having a high cold-resistance characteristic must be utilized in the construction of those elements of the ship's hull abutting or enclosing the cargo tanks. Also irrespective of the pressure exerted by the cargo, difficulties often arise in connection with use of the various tanks, particularly in the integrity of welded seams and the second barrier.

The object of the invention is to provide a ship for the transport of liquid or gaseous cargo in tanks which is more efficient in its use of ship space, safer in the event of collision, easier to repair in the event of leaks, less complicated in structure, and more economical to build and operate.

SUMMARY OF THE INVENTION

A ship for the transport of liquid or gaseous cargo (especially liquefied gas) in tanks comprises a plurality of supporting hulls, a plurality of cargo tanks, and a connection structure maintaining the tanks spaced above the hulls and accessible from all sides. The abeam dimension of the tanks is preferably smaller than the abeam dimension of the connected hulls. The connecting structure may be disposed entirely above the water line of the ship, or at least in part below the water line.

BRIEF DESCRIPTION OF THE DRAWING

FIG. 1 shows a side view of the first embodiment of a ship according to the invention;

FIG. 2 is a top plan view of the ship according to FIG. 1;

FIG. 3 is a cross section view taken along the line III—III of FIG. 2;

FIG. 4 is a side view of a second embodiment;

FIG. 5 is a top plan view of the ship according to FIG. 4;

FIG. 6 is a cross section view taken along the line VI—VI of FIG. 5;

FIG. 7 is a side view of a third embodiment;

FIG. 8 is a cross section view taken along the line VIII—VIII of FIG. 7, and FIGS. 9, 10 and 11 are side views of a ship illustrating three alternative tank constructions.

DETAILED DESCRIPTION OF THE PREFERRED EMBODIMENTS

Referring now to the drawings, and in particular to FIGS. 1–3 illustrating the first embodiment of the present invention, the tanker has the shape of a catamaran with the supporting hulls 10 and 11 being of substantially rectangular cross section. A connection structure, here consisting of the four connection elements 12, 13, 14 and 15, maintains the hulls 10, 11 in longitudinally extending (i.e., stem-to-stern) substantially parallel disposition and supports the three cargo tanks 16, 17 and 18 spaced above the hulls 10, 11. The tanks 16–18 are longitudinally arranged, each being of substantially cylindrical configuration with spherical ends. Near the stem in front of the front tank 16 a navigating-bridge 19 is positioned on top of the connection element 12, whereas on the stern behind the rear tank 18 a deckhouse 20 is positioned on top of the connection element 15.

Referring now to FIGS. 4–6, therein illustrated is a second embodiment of the present invention, the second embodiment being similar to the first embodiment with two longitudinal rectangular hulls 21, 22, three transversely extending cargo tanks 23, 24 and 25, and a connection structure comprised of four connection elements 26, 27, 28 and 29.

Referring now to FIGS. 7–8, therein illustrated is a third embodiment of the present invention. Two torpedo-shaped hulls 31, 32 of rounded cross section are maintained in axially parallel disposition totally below the water level by a connection structure 33 which itself extends in part below the water level and comprises connection elements 34, 35, 36 and 37. Cylindrical cargo tanks 38, 39 and 40 are supported above the water line in longitudinal disposition by the connection structure 33.

In FIGS. 9, 10 and 11 a number of alternative tank constructions are shown. FIG. 9 illustrates longitudinally extending cylindrical tanks 16, 17, and 18; FIG. 10 illustrates transversely extending rectangular tanks 41, 42, 43 and 44; and FIG. 11 illustrates longitudinally spaced spherical tanks 51, 52, 53, 54 and 55.

It will be noted that in each of the embodiments according to the present invention, the cargo tanks are arranged above the hulls, so that fore and aft side partitions, double bottoms and cofferdam partitions become superfluous. The only purpose of the hulls is to deliver the necessary floating capacity and to receive the engine installation. Furthermore as the abeam (i.e., width or side-to-side) dimension of the tanks are less than the abeam dimension of the connected hulls (as connected by the connecting structure), the tanks are protected from side collisions. Also, where the connection structure is disposed entirely above the water line of the ship, as illustrated in connection with the first and second embodiments, the connection structure is protected from side collisions below the water line.

Each hull can be efficiently subdivided by means of one or more longitudinal partitions and a prescribed number of transverse partitions. The tank spaces thus created can serve to receive the necessary ballast liquid when sailing in ballast, or serve as cargo for liquid and/or dry cargo, such as oil, grain, general cargo and the like. The ship's hulls are connected to one another by suitable transverse connections, like the elements 12, 13, 14 and 15 of the connection structure, so that torsion, transverse and longitudinal forces can be efficiently received and distributed.

The various cargo tanks are arranged on the connection structure in such a way as to be freely accessible from all sides thereby facilitating both the detection and repair of tank leaks. To preclude hull damage from possible small leakages, for instance in the cargo tank or the related piping, provision is easily made to insure that the escaping liquid gas will not come in direct contact with one of the ship's hulls. Accordingly, the hulls may be made of normal ship-building steel, rather than cold-resistant material. For example, fluid conducting means 56 schematically indicated only in FIG. 6, made of cold-resistant material may be arranged in a plane under the tanks and above the hulls to receive leaking liquid gas and to discharge the leakage to the water. Alternatively, closed leak pans of cold-resistant material may be disposed between the ship's plates under the cargo tanks or an additional platform deck of cold-resistant material can be arranged under the cargo tanks.

A ship according to the present invention is useful not only for the transport of liquid natural gas, as described above, but also for other liquid or gaseous cargoes and especially for dangerous cargoes such as chemical products which require as much protection as possible against loss of cargo tank integrity due to collision damage. The cargo tanks may be of any configuration, preferably cylindrical, rectangular or spherical configuration, and the hulls may be of any cross section, preferably rectangular or rounded (torpedo-shaped) cross section.

Now that the preferred embodiments of the present invention have been shown and described, various additions and modifications thereof will become readily apparent to those skilled in the art. Accordingly, the spirit and scope of the present invention is to be limited not by the foregoing specification, but only by the appended claims.

I claim:

1. A ship for the transport of liquid or gaseous cargo in tanks, comprising

A. a plurality of supporting hulls,

B. a plurality of cargo tanks for liquefied gas, and

C. a superimposed connection structure connecting said hulls and maintaining said tanks in a protected environment spaced above and between said hulls and accessible from all sides;

said hulls being disposed at least in part below the water line of said ship, said connection structure being disposed at least in part above said water line, and said tanks being disposed entirely above said water line.

2. The ship according to claim 1, wherein the abeam dimension of said tanks is smaller than the abeam dimension of said connected hulls.

3. The ship according to claim 1 wherein a member of cold-resistant material is disposed in a plane beneath said tanks and above said hulls to receive tank-leakage.

4. The ship according to claim 1 wherein said connection structure is disposed at least in part below the water line of said ship.

5. The ship according to claim 1 wherein said connection structure is disposed entirely above the water line of said ship.

* * * * *